US006254335B1

(12) United States Patent
Ekholm et al.

(10) Patent No.: US 6,254,335 B1
(45) Date of Patent: Jul. 3, 2001

(54) DEVICE FOR ADMIXING A FIRST FLUID INTO A SECOND FLUID

(75) Inventors: Rolf Ekholm; Ulf Jansson, both of Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/254,906

(22) PCT Filed: Apr. 4, 1996

(86) PCT No.: PCT/SE96/00443

§ 371 Date: Oct. 9, 1997

§ 102(e) Date: Oct. 9, 1997

(87) PCT Pub. No.: WO96/33007

PCT Pub. Date: Oct. 24, 1996

(30) Foreign Application Priority Data

Apr. 19, 1995 (SE) ..... 9501458

(51) Int. Cl.[7] ..... F04D 31/00

(52) U.S. Cl. ..... 415/116; 415/198.1; 415/206; 415/216.1; 366/169.1

(58) Field of Search ..... 415/98, 116, 117, 415/198.1, 206, 216.1; 366/169.1, 262, 263, 265

(56) References Cited

U.S. PATENT DOCUMENTS

| | | | | |
|---|---|---|---|---|
| 4,388,045 | | 6/1983 | Simon . | |
| 5,385,443 | * | 1/1995 | Dufour | 415/116 |
| 5,711,852 | * | 1/1998 | Ekholm et al. | 162/57 |
| 5,863,120 | * | 1/1999 | Gallagher et al. | 366/171.1 |

FOREIGN PATENT DOCUMENTS

0320480 A1 * 6/1989 (EP) .

* cited by examiner

*Primary Examiner*—Edward K. Look
*Assistant Examiner*—Ninh Nguyen
(74) *Attorney, Agent, or Firm*—Fasth Law Offices; Rolf Fasth

(57) ABSTRACT

A device for admixing a first fluid into a second fluid. The device has a housing with a rotationally symmetrical rotation chamber defined therein that is arranged with an inlet for the second fluid and an outlet for the mixed fluids. A distance from a center shaft of the housing to its inner wall is decreasing continuously from the inlet to the outlet. The device has rotation means for setting the second fluid in rotation along the inner wall of the rotation chamber. The device also has adding means for adding the first fluid into the vortex that is formed when the second fluid is rotating in the rotation chamber.

11 Claims, 3 Drawing Sheets

DEVICE FOR ADMIXING A FIRST FLUID INTO A SECOND FLUID

TECHNICAL FIELD

The present invention relates to a device for mixing a first fluid into a second fluid, comprising a housing with a rotationally symmetrical rotation chamber having an inlet for the second fluid and an outlet for the mixed fluids, the internal diameter of the housing decreasing continuously from the inlet to the outlet in at least one section of the rotation chamber converging in the direction towards the shaft, and also means for setting the second fluid in rotation along the inner wall of the rotation chamber.

PRIOR ART

In the chemical pulp industry it is extremely common to admix different fluids into pulp suspensions at different stages in the process, for example chlorine dioxide or other bleaching agents in liquid or gaseous form in a bleaching department chain. In pressurized systems, such as these are, it has been found to be difficult to supply and admix these fluids, especially in gaseous form, since they are difficult to pressurize to system pressures, which may be up to 10 bar overpressure. To make the admixing easier, it would be desirable to reduce the pressure at the point of addition. However, since the pressure across a mixer device should preferably not change appreciably, it would be necessary to raise the pressure again after the said pressure reduction. To this day, as far as the inventors are aware, no device has been produced which is able to do this.

DESCRIPTION OF THE INVENTION

The object of the present invention is to overcome the difficulties encountered when admixing gas, in particular, in pressurized systems. This object is achieved by a device of the type mentioned in the introduction, which is characterized by means for adding the first fluid into the vortex which is formed when the second fluid is rotating in the said chamber. Further characteristics and aspects of the invention will be evident from the patent claims and from the following description of a preferred embodiment.

BRIEF DESCRIPTION OF THE FIGURES

A preferred embodiment of the present invention will be described hereinafter with reference to the drawing figures, in which.

DESCRIPTION OF A PREFERRED EMBODIMENT

Figure 1:
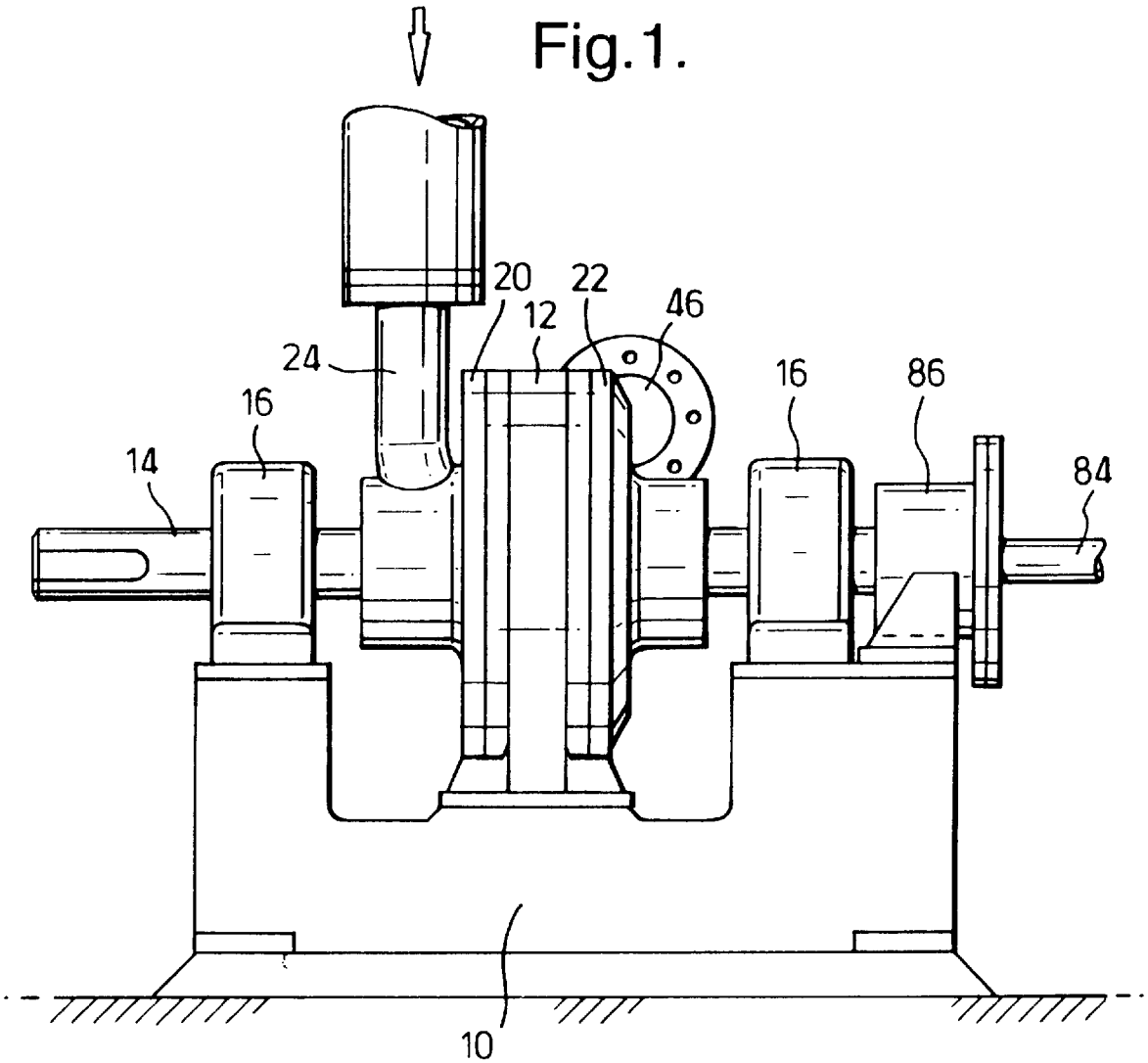
FIG. 1 is a side view of the device according to the invention.
Figure 2:
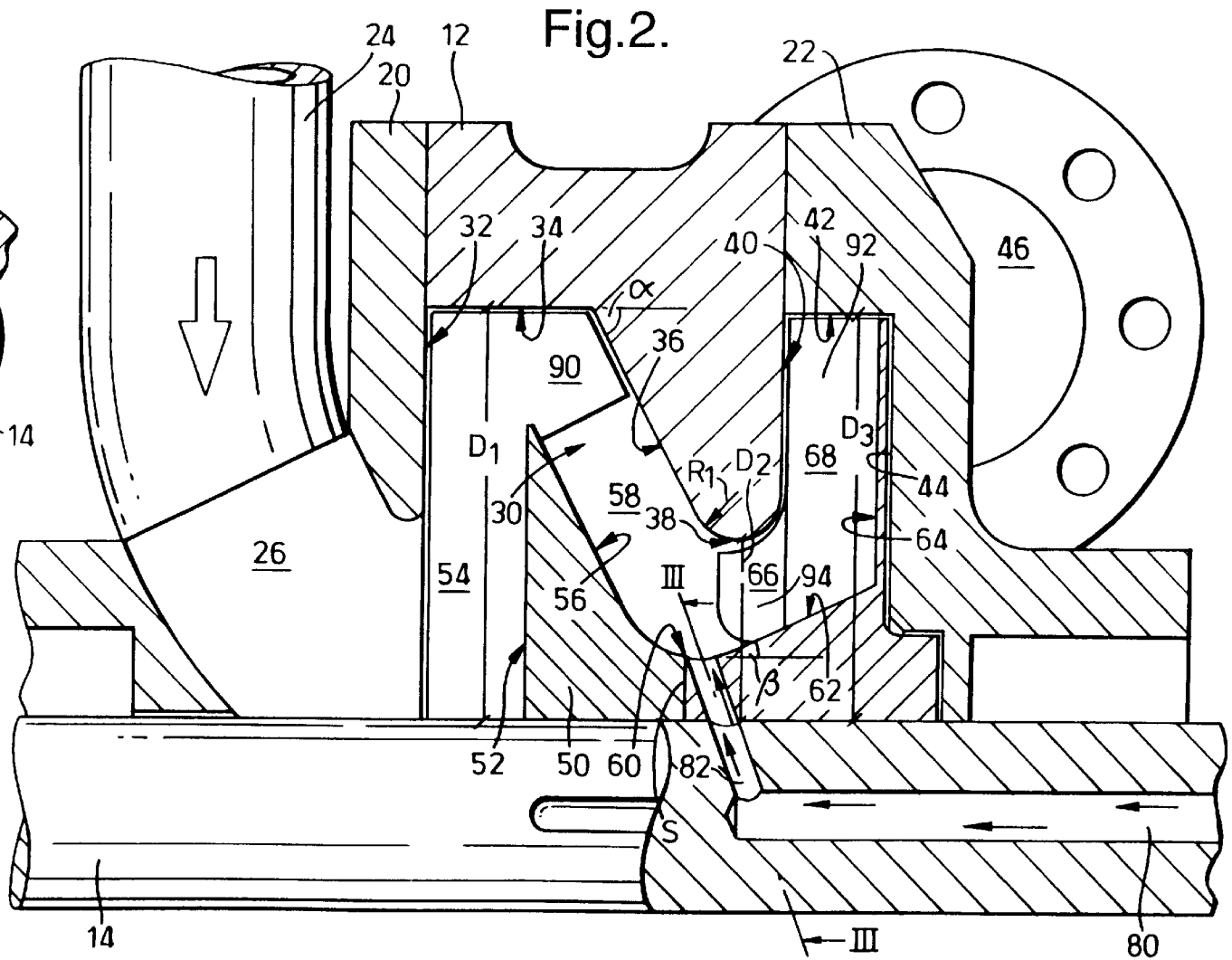
FIG. 2 is a partial view, in longitudinal section, of those parts of the device which participate in the admixing.

A preferred embodiment of the device according to the invention will be described with reference to the figures. According to FIG. 1, it comprises a stand 10 on which a housing 12 is fitted. A shaft 14 runs through the housing 12 and is rotatably mounted in two bearing housings 16, which are also fitted on the stand 10. A suitable drive mechanism (not shown) is connected to the shaft 14. The shaft 14 runs through two end walls 20, 22, here referred to as feed end wall 20 and discharge end wall 22, respectively, which end walls are fitted in a detachable manner on the housing 12 with the aid of screws, for example, and are sealed off from the housing 12. The through-passages for the shaft 14 in the end walls 20, 22 are sealed off in a suitable manner. Arranged at the feed end wall 20 there is an inlet 24 for the fluid which is to be treated, here referred to as the second fluid, in the form of a pipe connection. The inlet pipe 24 merges into the feed end wall 20 in an inlet passage 26, FIG. 2, which in this embodiment is directed obliquely in towards the shaft 14.

The inlet passage 26 is in communication with a rotation chamber 30 in the housing 12, which rotation chamber 30 is rotationally symmetrical. The circular inner side 32 of the feed end wall 20 is essentially plane and at right angles to the longitudinal direction of the shaft 14. Viewed in the direction from the feed end wall 20 towards the discharge end wall 22, the rotation chamber 30 has a first cylindrical wall section 34 which runs essentially parallel to the longitudinal direction of the shaft 14 and at a distance $D_1$ from the shaft 14. The first wall section 34 merges into a second conical wall section 36 which forms an angle a with respect to a plane parallel to the longitudinal direction of the shaft 14, so that the distance from the second wall section 36 to the shaft 14 decreases in the direction towards the discharge end wall 22. The second wall section 36 finishes in a rounded part 38 with a radius of curvature $R_1$ in order to merge into a third plane wall section 40 which is essentially at right angles to the longitudinal direction of the shaft 14. The rounded part 38 is at a distance $D_2$ from the shaft which is less than $D_1$, and the second wall section 36 thus acquires a funnel-shaped appearance in this section of the rotation chamber 30. The third wall section 40 merges at its periphery into the contact surface for the discharge end wall 22.

The rotation chamber 30 continues in the discharge end wall 22 via a fourth cylindrical wall section 42, which also runs essentially parallel to the longitudinal direction of the shaft 14 and at a distance $D_3$ from the shaft. The rotation chamber 30 finishes with a fifth plane, circular wall section 44 which is at right angles to the longitudinal direction of the shaft 14. A pipe connection 46 is arranged on the discharge end wall 22, which pipe connection 46 acts as an outlet for the mixed media. The outlet 46 is arranged tangentially at a site on the fourth wall section 42.

A rotationally symmetrical body 50, hereinafter referred to as the rotor, is secured on the shaft 14 with the aid of, for example, key joints inside the rotation chamber. In the preferred embodiment, the rotor 50 is divided in two along a cut S transverse to the longitudinal direction of the shaft in order to allow the rotor to be fitted in the rotation chamber 30. The two parts 50A and 50B of the rotor are fitted together in a suitable way, for example with screw connections. Viewed from the feed end wall 20 to the discharge end wall 22, the rotor 50 has a first wall section 52 which is parallel with the first wall section 32 of the rotation chamber 30 and at a distance from the latter, so that a column-shaped space 54 is formed between these wall sections, viewed in a longitudinal section along the shaft 14. The first, plane wall section 52 of the disc 50A of the rotor 50 merges into a second wall section 56 which is in turn essentially parallel to the second conical wall section 36 of the rotation chamber, and at a distance from this, so that here too a column-shaped, converging space 58 is obtained. The second wall section 56 of the rotor 50 merges, at its inner part nearest the shaft 14, into a rounded third wall section 60 with a radius of curvature $R_2$ in order thereafter to continue, in the second disc 50B, in an essentially conical fourth wall section 62 which forms an angle β with respect to the longitudinal direction of the shaft 14, in such a way that the distance from the fourth wall section 62 of the rotor to the shaft 14 increases when viewed from the feed end wall 20 towards the discharge end wall 22.

The fourth wall section 62 of the rotor merges into a fifth wall section 64 which is essentially parallel to the third wall section 40 of the rotation chamber and at a distance form this wall. A gap 66 is formed between the rounded section 38 of the rotation chamber and the fourth wall section 62 of the rotor, and a gap 68 is also formed between the third wall section 40 of the rotation chamber and the fifth wall section 64 of the rotor. As a result of the above-described configuration of the walls of the rotation chamber and the rotor, a column-shaped passage is obtained, in longitudinal section, which runs through the whole housing from the inlet to the outlet.

Figure 3:
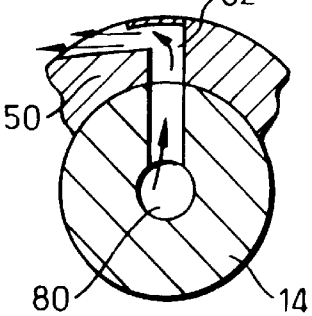
FIG. 3 is a view along the line III—III in FIG. 2.

The shaft 14 is provided with a longitudinal cavity 80 for the fluid which is to be admixed, here referred to as the first fluid, for at least some distance into the rotation chamber. This cavity 80 communicates with a transverse passage 82, which passage also extends through the rotor 50 and opens out approximately at the transition between the third rounded wall section 60 of the rotor and its fourth wall section 62. In the preferred embodiment, the passage 82 does not open out in the wall surfaces of the rotor at right angles to these, but instead tangentially with respect to the direction of rotation, FIG. 3, that is to say the passage 82 bends off just before it reaches the third wall section 60. In the embodiment shown, the rotor 50 is arranged with one outlet for the first fluid, but it can of course be provided with several tangentially directed outlets on the periphery of the rotor. The first fluid is supplied from a source (not shown) via pipe lines 84, FIG. 1, to a packing box 86 which bears sealingly around the shaft 14, and it is conveyed thence into the cavity 80 in the shaft. The space 66 downstream of the passages for the second fluid, viewed in the direction of flow, is referred to here as the mixing zone.

Figure 4:
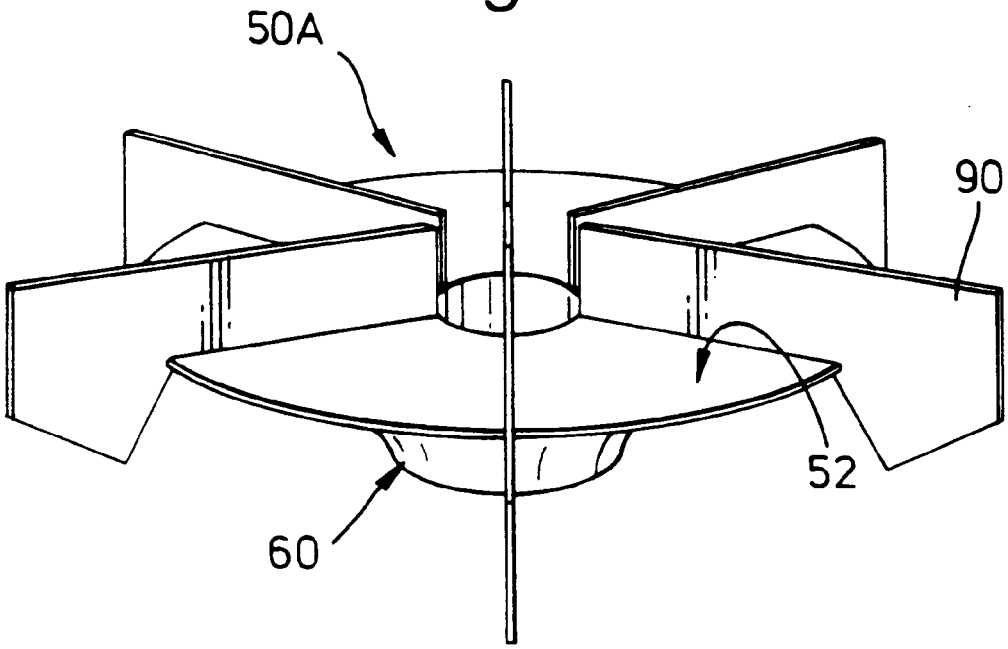
FIG. 4 is a perspective view of that part of a rotor which is provided with acceleration vanes.

The rotor is provided with a first set of vanes 90, here referred to as acceleration vanes, FIG. 4, secured on the first wall section 52 of the rotor. The vanes 90 extend from the shaft 14 out towards, and closely adjacent to, the first wall section 32 of the rotation chamber. The vanes 90 are in addition drawn round the corner between the first and second wall sections 52 and 56, respectively, of the rotor and extend some distance along the second wall section 34 of the rotation chamber. The space in which the acceleration vanes 90 move during rotation is referred to here as the activation zone. According to FIG. 3, the acceleration vanes 90 are designed straight and radial, but they can of course be curved.

Figure 5:
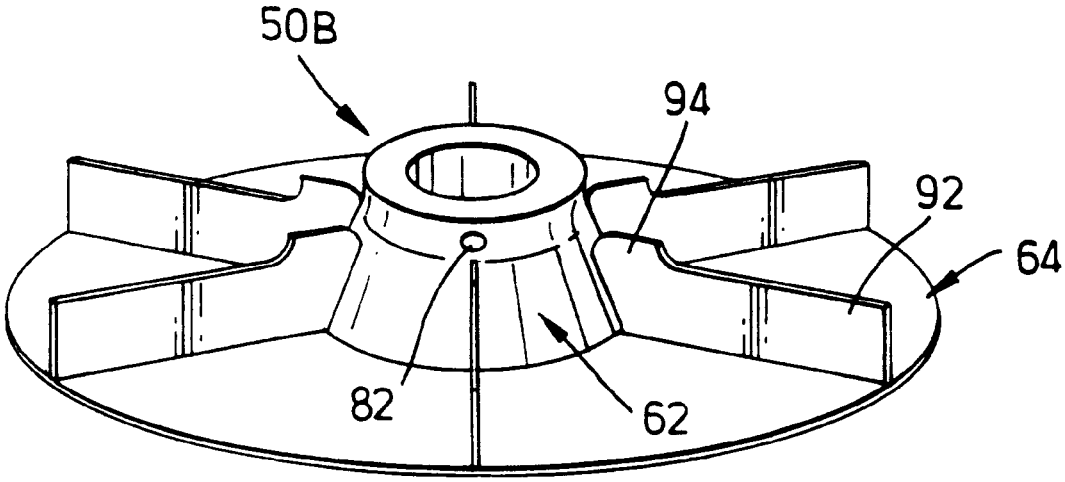
FIG. 5 is a perspective view of that part of a rotor which is provided with pressure-intensifying vanes and vortex breakers.

The second disc 50B of the rotor 50 is also provided with a second set of vanes 92, here referred to as pressure-intensifying vanes, FIG. 5, which are secured on the fourth wall section and fifth wall section 62, 64 of the rotor and in cross-section take up in principle the whole of column 68. The pressure-intensifying vanes 92 can be designed in a similar way to the acceleration vanes 90. The rotor 50 is also provided with vane blades 94, here referred to as vortex breakers, which extend into the space 66 between the fourth wall section 62 of the rotor and the curve 38 of the wall section in the rotation chamber and finish immediately downstream of the inlet for the first fluid, viewed in the direction of flow.

The vortex breakers 94 are preferably arranged on the pressure-intensifying vanes 92 close to the fifth wall section 64 of the rotor 50, in such a way that they form a continuation of these vanes into the mixing zone and are preferably arranged essentially at right angles to the direction of rotation. If necessary, the vortex breakers 94 can also be arranged on the fourth wall section 62 of the rotor 50 between the pressure-intensifying vanes 92. In the figures, both the acceleration vanes 90 and the pressure-intensifying vanes 92 are designed as six blades, although they can of course be present in another number. In addition, it may be advantageous to have different numbers of first and second vanes 90, 92 in order to prevent pulsing within the system. In this case, the first disc 50A with the acceleration wheel can be conceived of having seven vane blades 90 and the second disc 50B with the pressure-intensifying wheel of having six vane blades 92, although other designs are of course conceivable.

The device functions as follows. The shaft 14, and consequently the rotor 50, and the acceleration vanes 90 and pressure-intensifying vanes 92 on this rotor 50, are brought into rotation with the aid of a suitable drive mechanism (not shown) which is connected to the shaft 14. The suspension which is to be treated is led in via the pipe connection 24 to the inlet passage 26 and then into the column-shaped activation zone 54 near the shaft 14. The suspension is brought into rotation by the acceleration vanes 90 and is thrown out towards the periphery. The acceleration of the suspension means that the latter acquires a higher peripheral velocity than the velocity of the rotor 50. The rotating suspension is then led down along the funnel-shaped converging wall section 36 in the rotation chamber 30 where its peripheral velocity increases the nearer it comes to the centre. The funnel-shaped wall section 36 thus comes to act as a cyclone, and the suspension comes to gyrate around in this part, with an epicentre around the shaft 14.

The increase in peripheral velocity in this part gives rise to a considerable reduction in the pressure of the suspension, and this reduction in pressure is greater the closer to the epicentre. This reduction in pressure is desirable for the addition of the first fluid, and especially gas, since gas, such as chlorine dioxide, is difficult to pressurize. The inlet 82 for the first fluid is therefore arranged as near to the epicentre as possible, where the pressure is lowest. The first fluid is introduced through the cavity 80 in the shaft 14 and the passage 82 in the rotor. Since the outlet or the outlets are angled tangentially with respect to the direction of rotation, the first fluid is, so to speak, spread out around the narrowest section of the rotor and is entrained by the gyrating suspension. It is important that the first fluid to be admixed is introduced as smoothly as possible since the least disturbance immediately gives rise to an increase in pressure and poorer possibilities of good admixing. Tests have shown that the pressure of the suspension nearest the shaft in the area where the first fluid is added is atmospheric pressure or even below this, that is to say that a negative pressure is created there. This means that the first fluid is in principle sucked in or is at least supplied at extremely low pressure.

The vortex breakers 94 are arranged immediately downstream of the mixing zone, and since the suspension has a greater velocity than the rotor, the suspension strikes the side surfaces of the vortex breakers 94 and is decelerated. This deceleration gives rise to considerable turbulence in this area and consequently good admixing of the first fluid into the second, and good homogenization. The kinetic energy which the gyrating suspension possesses is therefore used for mixing of the two fluids. Since the pressure of the suspension after this has dropped substantially, it is led out to the pressure-intensifying vanes 92 where its pressure is intensified. Depending on the configuration of the pressure-intensifying vanes and their radius, the suspension is returned to the desired pressure. The pressure-intensified, mixed suspension is then led out through the tangential outlet in the discharge end wall and is conveyed onwards in the system. In the illustrated embodiment, the distance $D_3$ is approximately equal to the distance $D_1$, that is to say the diameter of the pressure-intensifying wheel is approximately equal to that of the acceleration wheel, which means that the pressure will be approximately the same at the discharge side as at the admission side.

The device can be manufactured using any suitable material whatsoever. However, it is expedient for the wall surfaces of the rotation chamber to be clad with a hard-wearing material, especially in the admixing zone, since the suspension gyrates at a high velocity along these surfaces and the suspension often contains a certain, albeit small, amount of sand and similar particles which wear the walls of the chamber, since the density of these particles causes them to lie in a layer furthest to the outside in the gyrating suspension.

It will be understood that the device according to the present invention is not limited to the embodiment which has been described above and which is shown in the figures, and instead it can be modified within the scope of the attached patent claims. Thus, it is possible for the suspension to be set in rotation in the chamber in another way, for example by means of tangential inlets. It is also possible to add the first fluid using other suitable members which are able to introduce the first fluid at or near to the epicentre. It is also conceivable for the vortex breakers to be arranged and/or designed in any desired way which is capable of breaking up the rotation of the second fluid. The same applies to the intensification of the pressure of the mixed suspension, which can be effected in a number of different ways so as to achieve the desired pressure after mixing. In addition, the wall sections of the rotation chamber and of the rotor, and the angles and curvatures of the wall sections, can be designed in different ways so as to achieve the desired flow and admixing.

What is claimed is:

1. A device for admixing a first fluid with a second fluid, comprising:

a housing having a rotationally symmetrical chamber defined therein, the housing having an inner wall;

an inlet conduit in fluid communication with the chamber for conducting the second fluid into the chamber;

an outlet conduit in fluid communication with the chamber;

a central shaft disposed in the housing, the central shaft being disposed a distance from a wall section of the inner wall so that the distance is continuously decreasing from the inlet conduit towards the outlet conduit;

a first vane member disposed in the housing for setting the second fluid in rotation along the inner wall so that the second fluid forms a vortex and for increasing a pressure of the second fluid before the first fluid is added;

a passage defined in the rotation member for adding a first fluid into the vortex; and a second vane member disposed in the housing for breaking up the rotation of the second fluid at a point that is downstream of the passage.

2. A device according to claim 1 wherein the first vane member is disposed adjacent to the inlet conduit to urge the second fluid outwardly and towards the wall section to bring the second fluid into rotation and the passage is located adjacent a rounded portion of the inner wall.

3. A device according to claim 1 wherein the passage comprises a cavity defined in the first vane member and an opening defined in the rotor.

4. A device according to claim 1 wherein an outlet of the passage is tangentially directed relative to a direction of rotation of the first vane member.

5. A device according to claim 2 wherein the second vane member is disposed downstream of the passage.

6. A device according to claim 2 wherein the first vane member is disposed upstream of the passage.

7. A device according to claim 6 wherein the first vane member is substantially perpendicular to a direction of rotation of the second fluid.

8. A device according to claim 5 wherein the first vane member is integral with the second vane member.

9. A device according to claim 1 wherein the device has a first number of first vane members and a second number of second vane members, the second number is greater than the first number.

10. A device according to claim 1 wherein the inner wall is clad with a wear resistant material.

11. A device for admixing a first fluid with a second fluid, comprising:

a housing having a rotationally symmetrical chamber defined therein, the housing having an inner wall;

an inlet conduit in fluid communication with the chamber for conducting the second fluid into the chamber;

an outlet conduit in fluid communication with the chamber;

a rotational shaft disposed in the housing, the rotational shaft being disposed a distance from a wall section of the inner wall so that the distance is continuously decreasing from the inlet conduit towards the outlet conduit, the rotational shaft extending through a center portion of the chamber;

a rotationally symmetrical rotor attached to the rotational shaft, the rotor having a first vane member attached thereto that is disposed adjacent to the inlet conduit to urge the second fluid outwardly and towards the wall section to bring the second fluid into rotation for setting the second fluid in rotation along the inner wall so that the second fluid forms a vortex;

a passage defined in the rotational shaft for adding a first fluid into the vortex, the passage comprising a cavity defined in the rotational shaft and an opening defined in the rotor, the passage being located adjacent a rounded portion of the inner wall;

the first vane member disposed in the housing for increasing a pressure of the second fluid before the first fluid is added; and a second vane member disposed in the housing for breaking up the rotation of the second fluid at a point that is downstream of the passage.

* * * * *